US007219728B2

(12) United States Patent
Veneruso et al.

(10) Patent No.: US 7,219,728 B2
(45) Date of Patent: May 22, 2007

(54) METHOD AND APPARATUS FOR GENERATING DOWNHOLE POWER

(75) Inventors: Anthony F. Veneruso, Missouri City, TX (US); Thomas D. MacDougall, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 303 days.

(21) Appl. No.: 10/711,866

(22) Filed: Oct. 11, 2004

(65) Prior Publication Data

US 2006/0076146 A1 Apr. 13, 2006

(51) Int. Cl.
*E21B 41/00* (2006.01)

(52) U.S. Cl. ..... 166/244.1; 166/65.1; 166/243

(58) Field of Classification Search ..... 166/373, 166/65.1, 243, 244.1, 375, 68, 105; 290/1 R, 290/43, 54; 60/398, 413; 417/150; 138/118, 138/114, 118.1; 175/228, 229
See application file for complete search history.

(56) References Cited

U.S. PATENT DOCUMENTS 1,334,632 A * 3/1920 Pickin ..... 175/228
3,048,230 A * 8/1962 Angel ..... 175/228
3,970,877 A 7/1976 Russell et al.
4,518,888 A 5/1985 Zabcik
5,323,855 A 6/1994 Evans
5,839,508 A 11/1998 Tubel et al.
5,965,964 A 10/1999 Skinner et al.
6,011,346 A 1/2000 Buchanan et al.
6,504,258 B2 1/2003 Schultz et al.
6,554,074 B2 4/2003 Longbottom
6,691,802 B2 2/2004 Schultz et al.
6,768,214 B2 7/2004 Schultz et al.

FOREIGN PATENT DOCUMENTS

WO WO 01/39284 A1 5/2001

* cited by examiner

*Primary Examiner*—Lanna Mai
*Assistant Examiner*—Matthew J. Smith
(74) *Attorney, Agent, or Firm*—Robert Van Someren; Dona C. Edwards; Jaime A. Castano

(57) ABSTRACT

A system that is usable with a subterranean well includes a first tubular member that is adapted to receive a flow of a first fluid. The system includes a second tubular member that is located in the flow and is substantially flexible to be moved by the flow to establish a pressure on a second fluid located inside the tubular member. A mechanism of the system uses this pressure to actuate a downhole tool.

23 Claims, 3 Drawing Sheets

METHOD AND APPARATUS FOR GENERATING DOWNHOLE POWER

BACKGROUND

The invention generally relates to generating downhole power.

A typical subterranean well includes various devices that are operated by mechanical motion, hydraulic power or electrical power. For devices that are operated by electrical or hydraulic power, control lines and/or electrical cables typically extend downhole for purposes of communicating power to these tools from a power source that is located at the surface. A potential challenge with this arrangement is that the space (inside the wellbore) that is available for routing various downhole cables and hydraulic control lines may be limited. Furthermore, the more hydraulic control lines and electrical cables that must be installed and routed downhole, the higher probability that some part of the power delivery infrastructure may fail.

Thus, some subterranean wells have tools that are powered by downhole power sources. For example, a fuel cell is one such downhole power source that may be used to generate electricity downhole. The subterranean well may include other types of downhole power sources, such as batteries, for example.

A typical subterranean well undergoes a significant amount of vibration (i.e., vibration on the order of Gs, for example) during the production of well fluid. In the past, the energy produced by this vibration has not been captured. However, an emerging trend in subterranean wells is the inclusion of devices to capture this vibrational energy for purposes of converting the energy into a suitable form for downhole power.

Thus, there is a continuing need for better ways to generate power downhole in a subterranean well.

SUMMARY

In an embodiment of the invention, a system that is usable with a subterranean well includes a first tubular member that is adapted to receive a flow of a first fluid. The system includes a second tubular member that is located in the flow and is substantially flexible to be moved by the flow to establish a pressure on a second fluid located inside the tubular member. A mechanism of the system uses this pressure to actuate a downhole tool.

Advantages and other features of the invention will become apparent from the following description, drawing and claims.

DETAILED DESCRIPTION

Figure 1:
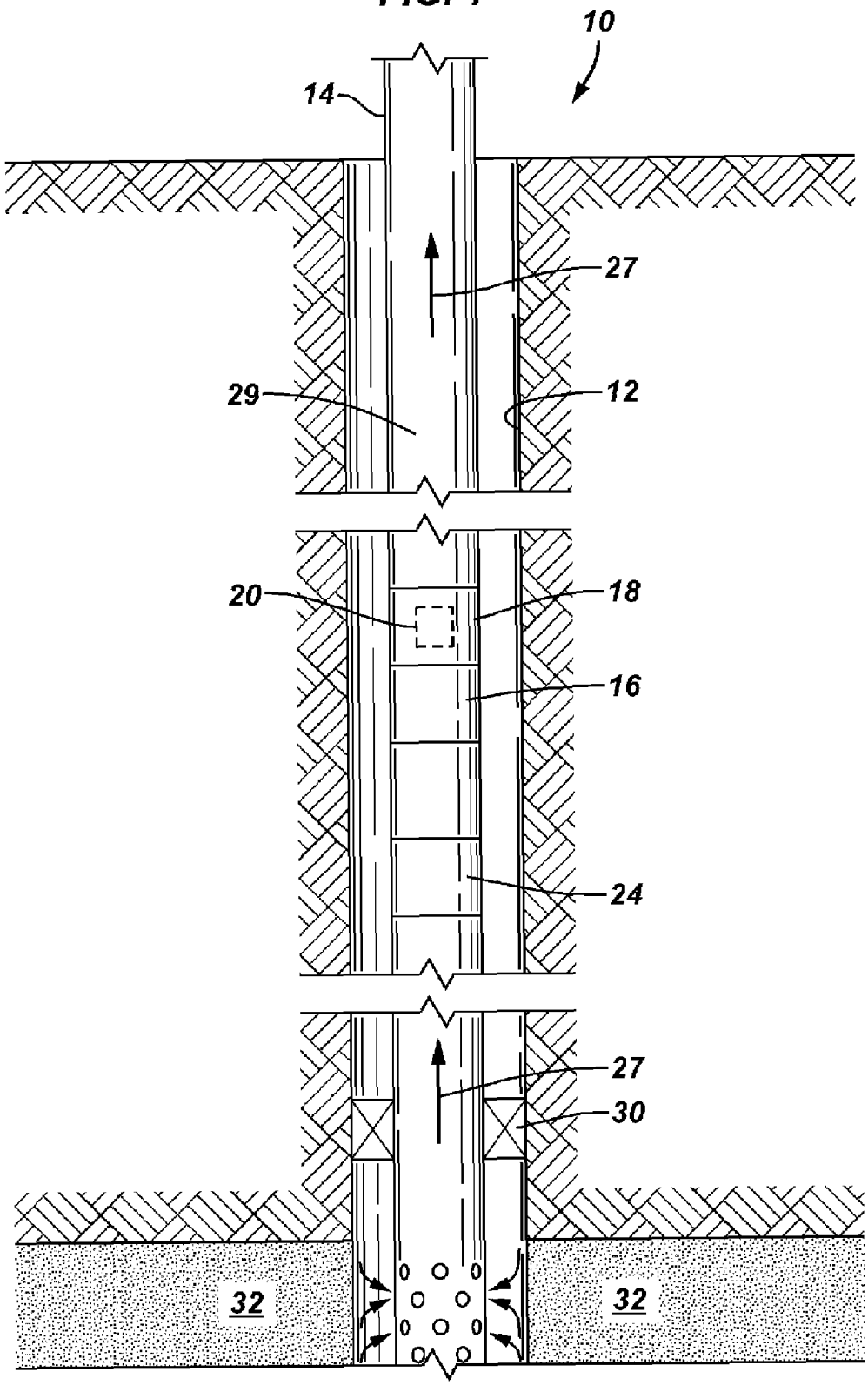
FIG. 1 is a schematic diagram of a well according to an embodiment of the invention.

Referring to FIG. 1, an embodiment 10 of a subterranean well in accordance with the invention includes a wellbore 12 that extends downhole through one or more subterranean formations. In the example depicted in FIG. 1, the system 10 may include a tubular string 14 (a production tubing, for example) that extends into the wellbore 12. In the exemplary system 10 depicted in FIG. 1, the well is uncased. However, in other embodiments of the invention, the wellbore 12 may be lined by a casing string. A packer 30 may seal and anchor the tubular string 14 to the wellbore 12.

The tubular string 14, in some embodiments of the invention, is a production tubing string that includes a central passageway 29 that receives the flow of production fluid from the well. For example, as depicted in FIG. 1, the tubular string 14 may receive the flow of well fluid (depicted generally by the arrows 27) from one or more zones, such as exemplary zone 32.

More specifically, the fluid flows from the zone 32 up through the central passageway 29 and returns to the surface of the well. Although FIG. 1 depicts a vertical well, it is understood that in other embodiments of the invention, the well 10 may include various lateral, or horizontal, wellbores. Thus, the well 10 is merely depicted as an example to illustrate the harnessing of power, described below.

In some embodiments of the invention, the tubular string 14 includes a pump 16 that harnesses energy that is generated or induced by the flow of production fluid through the tubular string 14. More specifically, in some embodiments of the invention, the pump 16 is a "lymphatic pump," in that the pump 16 directly converts energy induced by the flow or well fluid into hydraulic power that may be used to control one or more downhole tools of the string 14.

More specifically, in some embodiments of the invention, the pump 16 exerts hydraulic pressure on fluid that is stored in an accumulator 20 of a hydraulic system 18 of the string 14. The pressure accumulated in the accumulator 20, in turn, is used by the system 18 to drive, or actuate, one or more downhole tools 24 (one tool 24 being depicted in FIG. 1) of the tubular string 14. Depending on the particular embodiment of the invention, the tool 24 may be a sleeve, a valve, a packer, etc.

Figure 2:
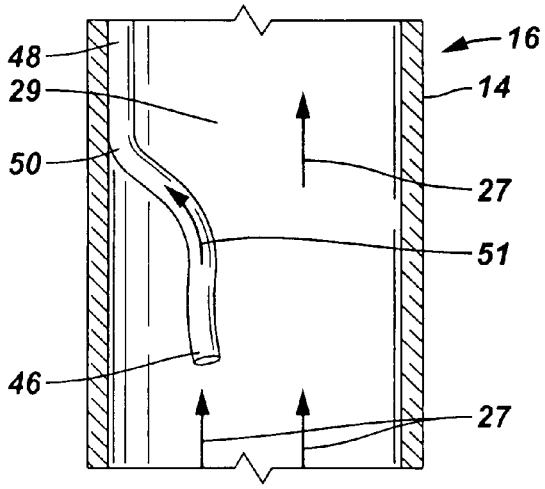
FIGS. 2, 3 and 4 depict a pump of FIG. 1 for different positions of a flexible tube of the pump according to an embodiment of the invention.

In some embodiments of the invention, the pump 16 may have a form that is generally depicted in FIG. 2. In particular, the pump 16 includes a substantially flexible tubular member 50 that is located inside the central passageway 29 of the tubular member 14. For example, in some embodiments of the invention, one end of the tubing 50 may be a free end 46, in that the end 50 moves with the flow 27. The opening at the end 46 is generally concentric with the longitudinal axis of the central passageway 29. Thus, a portion 51 of the flow 27 is diverted into the tubing 50 to create a flowpath from the end 46 to a distal end 48 of the flow tube 50. The pressure of this flow 51, in turn, is affected by the movement of the flow tube 50.

Figure 3:
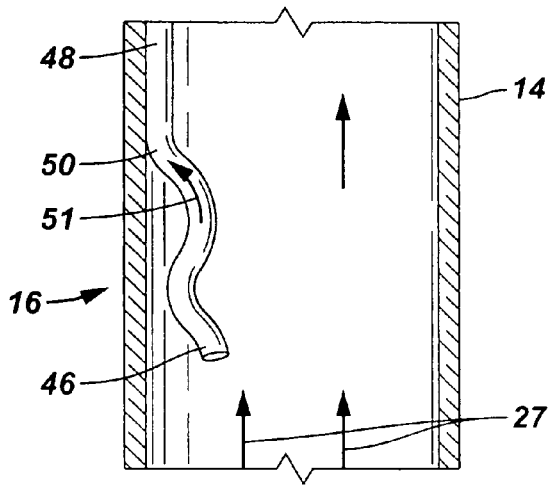
Figure 4:
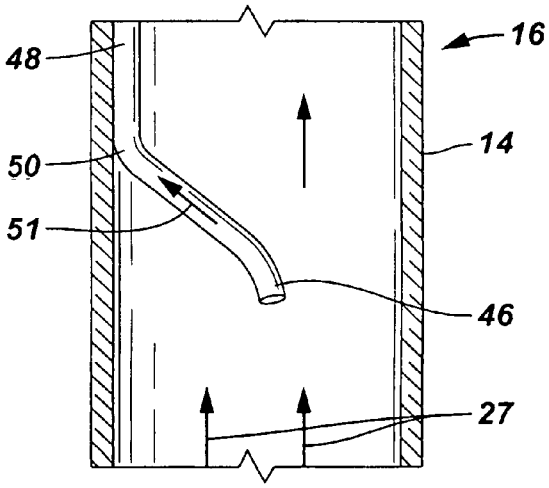

More specifically, in some embodiments of the invention, the flow tube 50 moves due to the flow 27, as depicted in FIGS. 2, 3 and 4 for three different positions of the flow tube 50. This waving action of the flow tube 50 serves to pump the flow 51 to pressurize fluid in the flow 51. It is this pressure that may be used to actuate one or more downhole tools.

Figure 5:
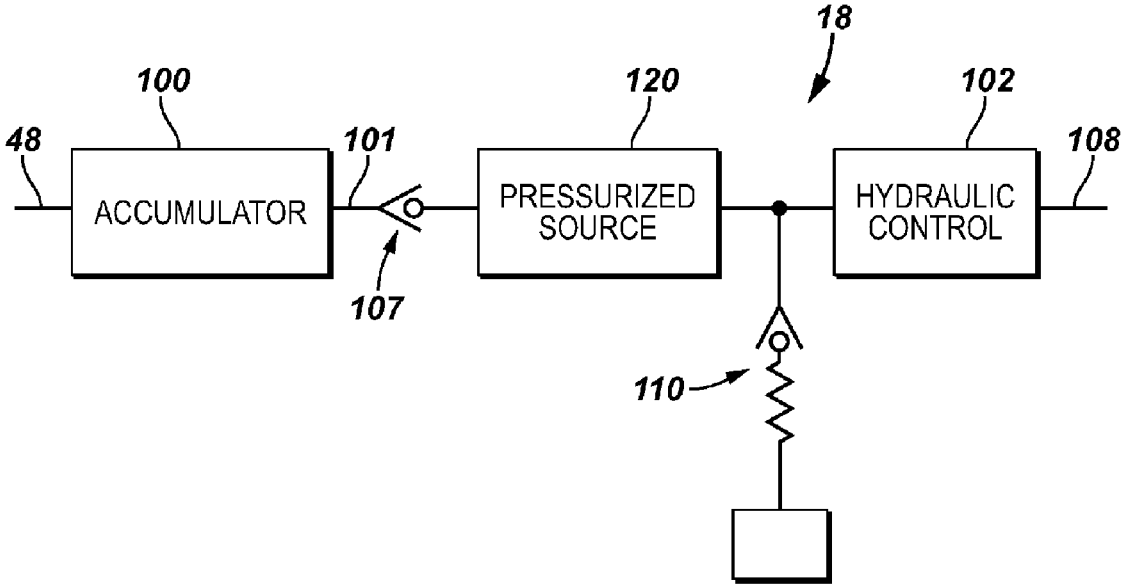
FIG. 5 is a block diagram of a hydraulic system according to an embodiment of the invention.

Referring to FIG. 5, in some embodiments of the invention, the hydraulic system 18 may have a form like the one generally depicted in FIG. 5. In the system 18, the end 48 of the flow tube 50 communicates the flow 51 to an accumulator 100. The accumulator 100 may include, for example, a first chamber in communication with the flow 51 that is separated from a second chamber, containing a hydraulic control fluid, by a piston, for example. Thus, the accumulation of pressure from the flow 51 establishes a control pressure in a hydraulic output line 101 of the accumulator 100. In some embodiments of the invention, the hydraulic output line 101 may be connected through a check valve 107 to a pressurized source 120. Thus, the accumulator 100 may serve to pressurize a particular source 120 for purposes of forming a direct hydraulic power source. A hydraulic control circuit 102 is in communication with the pressurized source 120 for purposes of controlling when this pressurized source is applied to one or more downhole tools via hydraulic output lines 108. Other variations are possible and are within the scope of the appended claims.

Referring to FIG. 5, in some embodiments the hydraulic control also includes a maximum pressure relief valve 110 that provides an upper limit on the pressurized source. In some embodiments of the invention, the hydraulic system 18 may be a closed system in that the maximum pressure relief valve 110 is connected to a chamber to effectively "store" a maximum pressure in the well. This chamber may be used to power one or more downhole tools, for example.

Figure 6:
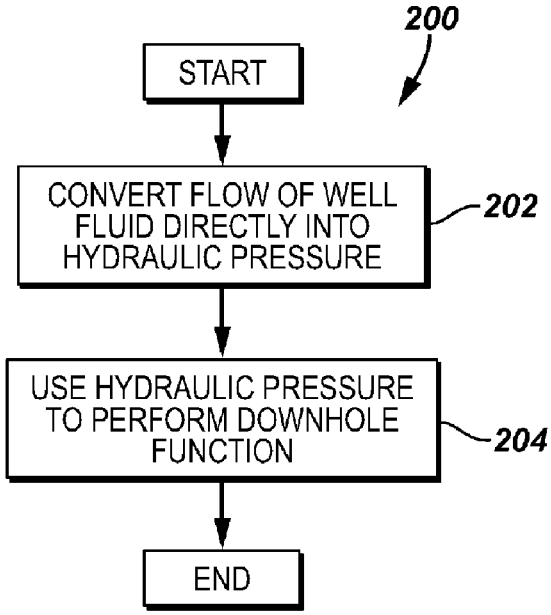
FIG. 6 is a flow diagram depicting a technique to harness downhole energy according to an embodiment of the invention.

Thus, referring to FIG. 6, in some embodiments of the invention, a technique 200 may be used for purposes of performing a particular downhole function. Pursuant to the technique 200, a flow of well fluid is directly converted into hydraulic pressure, as depicted in block 202. The hydraulic pressure is then used (block 204) to perform some downhole function. For example, this downhole function may be the actuation of a valve, the movement of a sleeve, the setting of a packer, etc.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. A system usable with a subterranean well, comprising:

a first tubular member adapted to receive a flow of a first fluid;

a second tubular member located in the flow and substantially flexible to be moved by the flow to establish a pressure on a second fluid inside the second tubular members; and a mechanism to use the pressure to actuate a downhole tool.

2. The system of claim 1, wherein the second tubular member is attached at one end to the first tubular member and has an unattached free end.

3. The system of claim 1, wherein the second tubular member comprises an end to receive some of the flow of the first fluid and some of the flow of the first fluid comprises the second fluid.

4. The system of claim 1, wherein the mechanism comprises an accumulator.

5. The system of claim 1, wherein the mechanism solely uses the pressure to actuate the downhole tool.

6. The system of claim 1, wherein the tool comprises at least one of a sleeve, packer and a valve.

7. A method usable with a subterranean well, comprising:

receiving a flow of a fluid in a subterranean well;

using a substantially flexible member located in the flow to pump a second fluid inside a tubular member to establish a pressure on the second fluid;

using the pressure to actuate a downhole tool; and attaching the tubular member so that at least some of the flow enters the tubular member to establish the second fluid.

8. The method of claim 7, further comprising:

attaching the tubular member to one end of a production tubing and leaving the other end of the tubular member free.

9. The method of claim 7, further comprising:

accumulating the second fluid to establish a pressure on the second fluid.

10. The method of claim 7, further comprising:

solely using the pressure to actuate the downhole tool.

11. The method of claim 7, wherein the tool comprises at least one of a sleeve, a packer and a valve.

12. A system usable with a subterranean well, comprising:

a first tubular member to receive a flow; and a second tubular member to move in the flow to pump at least part of the flow to establish a hydraulic pressure to operate a downhole tool.

13. The system of claim 12, wherein the second tubular member is attached at one end to the first tubular member and has an unattached free end.

14. The system of claim 13, wherein the second tubular member comprises an end to receive some of the flow of the first fluid and some of the flow of the first fluid comprises the second fluid.

15. The system of claim 12, wherein the mechanism comprises an accumulator.

16. The system of claim 12, wherein the mechanism solely uses the pressure to actuate the downhole tool.

17. The system of claim 12, wherein the tool comprises at least one of a sleeve, packer and a valve.

18. A method usable with a subterranean well, comprising:

placing a flexible tube in a flow in a subterranean well to pump at least part of the flow to establish a hydraulic pressure to operate a downhole tool.

19. The method of claim 18, further comprising:

attaching the tubular member to one end of a production tubing and leaving the other end of the tubular member free.

20. The method of claim 18, further comprising:

attaching the tubular member so that at least some of the flow enters the tubular member to establish the second fluid.

21. The method of claim 18, further comprising:

accumulating the second fluid to establish a pressure on the second fluid.

22. The method of claim 18, further comprising:

solely using the pressure to actuate the downhole tool.

23. The method of claim 18, wherein the tool comprises at least one of a sleeve, a packer and a valve.

* * * * *